US006260404B1

(12) United States Patent
Aota et al.

(10) Patent No.: US 6,260,404 B1
(45) Date of Patent: Jul. 17, 2001

(54) METHOD FOR MANUFACTURING A CYLINDER INTERIOR FUEL INJECTION VALVE AND APPARATUS FOR ADJUSTING A FUEL INJECTION AMOUNT USED THEREFOR

(75) Inventors: Masayuki Aota; Mamoru Sumida; Kazuo Matsunaga, all of Tokyo; Tsuyoshi Munezane, Hyogo, all of (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/096,356

(22) Filed: Jun. 12, 1998

(30) Foreign Application Priority Data

Jan. 20, 1998 (JP) ..... 10-008891

(51) Int. Cl.[7] ..... F01F 25/00; F02M 65/00

(52) U.S. Cl. ..... 73/1.36; 73/1.74; 73/119 A; 73/1.72; 29/888.4

(58) Field of Search ..... 73/1.36, 1.72, 73/1.74, 119 A; 123/476; 29/888.4, 888.42, 888.46

(56) References Cited

U.S. PATENT DOCUMENTS

| | | | | |
|---|---|---|---|---|
| 3,408,862 | * | 11/1968 | Hainz | 75/119 A |
| 3,946,590 | * | 3/1976 | Bechstein et al. | 73/1.36 X |
| 4,254,653 | * | 3/1981 | Casey et al. | 73/119 A X |
| 4,359,032 | * | 11/1982 | Ohie | 123/458 |
| 4,437,341 | * | 3/1984 | Ito et al. | 73/119 A |
| 4,725,396 | * | 2/1988 | Kushida et al. | 264/272.15 |
| 4,903,669 | * | 2/1990 | Groff et al. | 73/119 A X |
| 5,143,301 | * | 9/1992 | Reiter et al. | 239/585.4 |
| 5,241,858 | * | 9/1993 | Wieczorek et al. | 73/119 A |
| 5,535,621 | * | 7/1996 | Glidewell et al. | 73/119 A |
| 5,630,400 | * | 5/1997 | Sumide et al. | 123/470 |
| 5,634,448 | * | 6/1997 | Shinogle et al. | 73/119 A X |
| 5,641,891 | * | 6/1997 | Frankl et al. | 73/1.72 |
| 5,692,476 | * | 12/1997 | Egler et al. | 123/456 |
| 5,806,487 | * | 9/1998 | Dolenc | 73/119 A |

FOREIGN PATENT DOCUMENTS

| | | | | |
|---|---|---|---|---|
| 282463 | * | 9/1988 | (EP) | 73/119 A |
| 1439932 | * | 6/1976 | (GB) | 73/119 A |
| 2052073 | * | 1/1981 | (GB) | 73/119 A |
| 2223537 | * | 4/1990 | (GB) | 73/119 A |
| 155275 | * | 9/1983 | (JP) | 73/119 A |
| 1861 | * | 1/1986 | (JP) | 73/119 A |
| 1-104960 | | 4/1989 | (JP) . | |
| 5-288130 | * | 11/1993 | (JP) . | |
| 9-112382 | | 4/1997 | (JP) . | |

* cited by examiner

*Primary Examiner*—Thomas P. Noland
(74) *Attorney, Agent, or Firm*—Sughrue, Mion, Zinn, Macpeak & Seas, PLLC

(57) ABSTRACT

A method for manufacturing a cylinder interior fuel injection valve and an apparatus for adjusting a fuel injection amount used therefor may sufficiently cope with a fluctuation in fuel pressure or combustion gas pressure that would occur in an actual engine. According to this manufacturing method, a position of an adjuster is adjusted (step 110), a fuel injection amount is measured (step 111), and it is judged whether or not the measured value of the fuel injection amount falls within a range of a rated value (step 112). Then, if the fuel injection amount is out of the range of the rated value, the process is returned back to the step 110, and if it falls within the range of the rated value, the process shifts to a subsequent step 113. Subsequently, a spring force of a valve closing spring is measured (step 113), and it is judged whether or not the measured value of the spring force falls within a control range (step 114). Then, if the spring force is out of the control range, the process is returned back to the step 110, and if it falls within the control range, the adjuster is fixed (step 115) and the process shifts to a next step.

12 Claims, 8 Drawing Sheets

METHOD FOR MANUFACTURING A CYLINDER INTERIOR FUEL INJECTION VALVE AND APPARATUS FOR ADJUSTING A FUEL INJECTION AMOUNT USED THEREFOR

BACKGROUND OF THE INVENTION

1. Field of the Invention

The present invention relates to a method for manufacturing a cylinder interior fuel injection valve for directly injecting fuel into a combustion chamber of an internal combustion engine, and an apparatus for adjusting a fuel injection amount used therefor.

2. Description of the Related Art

FIG. 6 is a cross-sectional view showing a cylinder interior fuel injection valve.

In FIG. 6, a cylinder interior fuel injection valve 1 is composed of a housing body 2 and a valve assembly 3 fixed to one end of the housing body 2 by press-fitting or the like and covered by a sleeve 35. A fuel supply pipe (not shown) is connected to the other end of the housing body 2 for supplying pressurized fuel from the fuel supply pipe through a filter 37 into the cylinder interior fuel injection valve 1.

The housing body 2 is provided with a first housing 30 having a flange 30*a* for mounting the cylinder interior fuel injection valve 1 on a cylinder head (not shown) of an internal combustion engine, and a second housing 40 on which a solenoid assembly 50 is mounted. The solenoid assembly 50 is provided with a bobbin 52 around which a coil 51 is wound and a core 53 installed in an inner circumferential portion of the bobbin 52. A winding of the coil 51 is connected to a terminal 56. The core 53 is formed into a hollow cylindrical shape so that its interior serves as a fuel passage. A valve closing spring 55 is interposed and compressed between an adjuster 54 and a needle valve 12 in the hollow cylindrical portion. An armature 31 is mounted at the other end of the needle valve 12 so as to face to a tip end of the core 53. Disposed in an intermediate portion of the needle valve 12 are a guide 12*a* for sliding and guiding the valve 12 along the inner circumferential surface of a valve body 9 and a needle flange 12*b* which is in contact with a spacer 32 disposed in the first housing 30. The housing body 2 constitutes a housing of the cylinder interior fuel injection valve 1 in cooperation with the sleeve 35.

The valve assembly 3 is provided with a stepped hollow cylindrical valve main body 9 having a small diameter portion 7 and a large diameter portion 8, a valve seat 11 having a fuel injection port 10 and fixed to a tip end of a center hole within the valve main body 9, a needle valve 12 serving as a valve body for being seated on or separated away from the seat 11 by the solenoid assembly 50 for opening and closing the fuel injection port 10, and a swirl member 13 for guiding the needle valve 12 in an axial direction while imparting a swirl motion to the fuel to be introduced into the fuel injection port 10 of the seat 11 in a radially inward direction.

Here, the first housing 30, the core 53 and the armature 31 are made of magnetic material, for example, electromagnetic stainless steel to form a magnetic circuit.

The tip end side of the thus constructed cylinder interior fuel injection valve 1 is inserted into a fuel injection insertion hole (not shown) provided in the cylinder head, a retainer jig (not shown) is applied to the flange 30*a* from the outside, and the retainer jig is securely fastened to the cylinder head by mounting bolts (not shown). A flat washer or a corrugated washer is interposed between the cylinder interior fuel injection valve 1 and the cylinder head and a seal between the cylinder interior fuel injection valve 1 and the cylinder head is maintained by a pressure of the retainer jig in the axial direction. Also, a mounting hole of the fuel supply pipe is fitted and fixed to an O-ring portion for sealing the upper portion of the cylinder interior fuel injection valve 1.

Then, the electric application to the coil 51 is controlled so that the needle valve 12 is moved in the axial direction to open/close the fuel injection port 10.

Then, when the fuel injection port 10 is open, the pressurized fuel fed from the fuel supply pipe is caused to pass through the fuel passage in the interior of the core 53 and is subjected to the swirl energy by the swirl member 13 to be atomized and injected from the fuel injection port 10 into the combustion chamber.

A method for manufacturing the conventional cylinder interior fuel injection valve 1 will now be described with reference to FIG. 7.

In the method for manufacturing the conventional cylinder interior fuel injection valve 1, it is necessary to adjust the fuel injection amount so that it falls within a range of a rated value. The fuel injection amount adjusting step is carried out before the fixture of the adjuster 54 to the core 53. As shown in FIG. 8, under the condition that the fuel filter 37 is removed away, an adjusting pin 18 inserted from the fuel supply side is inserted or retracted so that the axial position of the adjuster 54 is adjusted to change the compression amount of the valve closing spring 55 to adjust the fuel injection amount.

Namely, the adjusting pin 18 inserted from the fuel supply side is moved in the axial direction to adjust the position of the adjuster 54 (step 100), and at this time, the fuel injection amount is measured (step 101). It is then judged whether or not the measured value of the fuel injection amount falls within the rated range (step 102). If the measured value of the fuel injection amount falls within the rated range, the core 53 is press-fitted from the outside. The adjuster 54 is fixed to the core 53 (step 103) to finish the fuel injection amount adjusting step. The process moves to the next step (step 104). Also, if the measured value of the fuel injection amount does not fall within the rated range, the process is returned back to step 100, and the position of the adjuster 54 is adjusted again so that the fuel injection amount falls within the rated range.

The following function in addition to the function of adjusting the fuel injection amount as described above is required for the spring force of the valve closing spring 55 in such a kind of the cylinder interior fuel injection valve 1.

First, the cylinder interior fuel injection valve 1 faces to the combustion chamber of the internal combustion engine and the combustion gas pressure of the combustion chamber is applied to the needle valve 12 in the valve opening direction. It is necessary to set a lower limit to the spring force of the valve closing spring 55 so that the needle valve 12 is seated on the valve seat 11 to maintain the valve closed condition and the introduction of the combustion gas into the cylinder interior fuel injection valve 1 is prevented even if the combustion gas pressure is applied to the needle valve 12 in the non-application of the current to the coil 51.

Secondly, the magnetic suction force of the solenoid assembly 50 has to be greater than the sum of the force in the valve closing direction by the spring force of the valve closing spring 55 and the force in the valve closing direction by the fuel pressure in order to open the needle valve 12 in the electric application to the coil 51. The fuel pressure used in such a kind of a cylinder interior fuel injection valve 1 is high in comparison with the conventional fuel injection valve, and the force in the valve closing direction by the fuel pressure is also high. However, the excessively increasing the suction force of the solenoid assembly 50 for coping with this would raise the problems in size, heat generation and cost. Accordingly, an upper limit has to be set for the spring force of the valve closing spring 55, and the needle valve 12 has to be opened to inject fuel upon the electric application to the coil 51 within the fuel pressure range which would be generated in the actual product.

However, in the adjusting step of the fuel injection amount in the manufacturing method of the conventional cylinder interior fuel injection valve 1, the positional adjustment of the adjuster 54 is repeated so that the fuel injection amount is the target value, and when the fuel injection amount is the target value, the core 53 is press-fitted to adjuster 54 which is thereby fixed to the core 53. Accordingly, the spring force of the valve closing spring 55 of the cylinder interior fuel injection valve 1 that has been produced is unknown. In other words, in the conventional manufacturing method, since the spring force of the valve closing spring 55 is not controlled, there is a problem that the combustion gas would be introduced into the interior of the fuel injection valve to generate the air engagement due to the fluctuation in the combustion gas pressure or the fuel pressure that would occur when the fuel injection valve is mounted on the actual engine, or the needle valve 12 would not be opened upon the electric application to the coil so that the predetermined fuel injection amount could not be obtained.

SUMMARY OF THE INVENTION

In order to overcome the above-noted difficulty, an object of the present invention is to provide a method for manufacturing a cylinder interior fuel injection valve which may sufficiently cope with a fluctuation in combustion gas pressure or fuel pressure that would occur when the fuel injection valve is mounted on an actual engine by using a spring force of a valve opening spring in addition to the fuel injection amount as a control item and which may attain a high yield and a fuel injection amount adjusting apparatus used therefor.

In order to achieve the above object, according to one aspect of the invention, there is provided a manufacturing method for a cylinder interior fuel injection valve composed of, a housing having a fuel passage along an axis, a valve assembly having a valve seat provided with a fuel injection port and a valve body for contacting with or separating from the valve seat to open/close the fuel injection port and fixed to one end of the housing so as to project a side of the fuel injection port, a solenoid assembly installed in the housing for magnetically sucking the valve body in a valve opening direction, a valve closing spring received in the fuel passage of the housing for biasing the valve body in a valve closing direction, and an adjuster fixed to the fuel passage of the housing for depressing the valve closing spring toward the valve seat; the manufacturing method comprising the steps of: adjusting the position of the adjuster in the fuel passage of the housing so that a fuel injection amount may fall within a range of a rated value of the fuel injection amount and a spring force of the valve closing spring may fall within a set control range of the spring force; and fixing the adjuster which has been adjusted in position to the housing.

According to another aspect of the present invention, there is provided a fuel injection amount adjusting apparatus for a cylinder interior fuel injection valve composed of, a housing having a fuel passage along an axis, a valve assembly having a valve seat provided with a fuel injection port and a valve body for contacting with or separating from the valve seat to open/close the fuel injection port and fixed to one end of the housing so as to project a side of the fuel injection port, a solenoid assembly installed in the housing for magnetically sucking the valve body in a valve opening direction, a valve closing spring received in the fuel passage of the housing for biasing the valve body in a valve closing direction, and an adjuster inserted into the fuel passage of the housing for depressing the valve closing spring toward the valve seat; the fuel injection amount adjusting apparatus comprising: a body having a mounting hole provided on one end side thereof, a load cell insertion hole provided coaxially with the mounting hole on the other end side thereof, an adjusting pin insertion hole provided coaxially for communicating the mounting hole and the load cell insertion hole with each other and a fuel supply passage communicated with the mounting hole; an adjusting pin received movably in an axial direction in the adjusting pin insertion hole with one end projecting from the mounting hole and the other end projecting into the load cell insertion hole for adjusting a position of the adjuster; a load cell received in the load cell insertion hole with one end connected to the other end of the adjusting pin; a drive pin received in the load cell insertion hole with one end connected to the other end of the load cell; and a drive means for reciprocating the drive pin in the axial direction, wherein the body is mounted on the housing under the condition that the other end side of the housing is inserted into the mounting hole and the fuel may be supplied to the fuel passage of the housing through the fuel supply passage, and the drive pin is moved in the axial direction by the drive means so that the movement force of the drive pin is transmitted to the adjuster through the load cell and the adjusting pin to compress the valve closing spring, whereby the fuel injection amount to be determined in response to the spring force of the valve closing spring being adjusted and a repulsive force of the valve closing spring to be applied to the load cell being measured as the spring force of the valve closing valve by the load cell.

According to another aspect of the present invention, there is provided a manufacturing method for a cylinder interior fuel injection valve composed of, a housing having a fuel passage along an axis, a valve assembly having a valve seat provided with a fuel injection port and a valve body for contacting with or separating from the valve seat to open/close the fuel injection port and fixed to one end of the housing so as to project a side of the fuel injection port, a solenoid assembly installed in the housing for magnetically sucking the valve body in a valve opening direction, a valve closing spring received in the fuel passage of the housing for biasing the valve body in a valve closing direction, and an adjuster fixed to the fuel passage of the housing for depressing the valve closing spring toward the valve seat; the manufacturing method comprising the steps of: measuring a fuel injection amount by changing an axial position of the adjuster within the fuel passage of the housing and adjusting the position of the adjuster so that the measured value thereof may fall within a range of a rated value of the fuel injection amount; fixing the adjuster which has been adjusted in position to the housing; and measuring the spring force of the valve losing spring after the adjuster is fixed to the housing and judging whether or not the measured value falls within a control range of the spring force.

DETAILED DESCRIPTION OF THE PREFERRED EMBODIMENTS

An embodiment of the present invention will now be described with reference to the accompanying drawings.

EMBODIMENT 1

Figure 1:
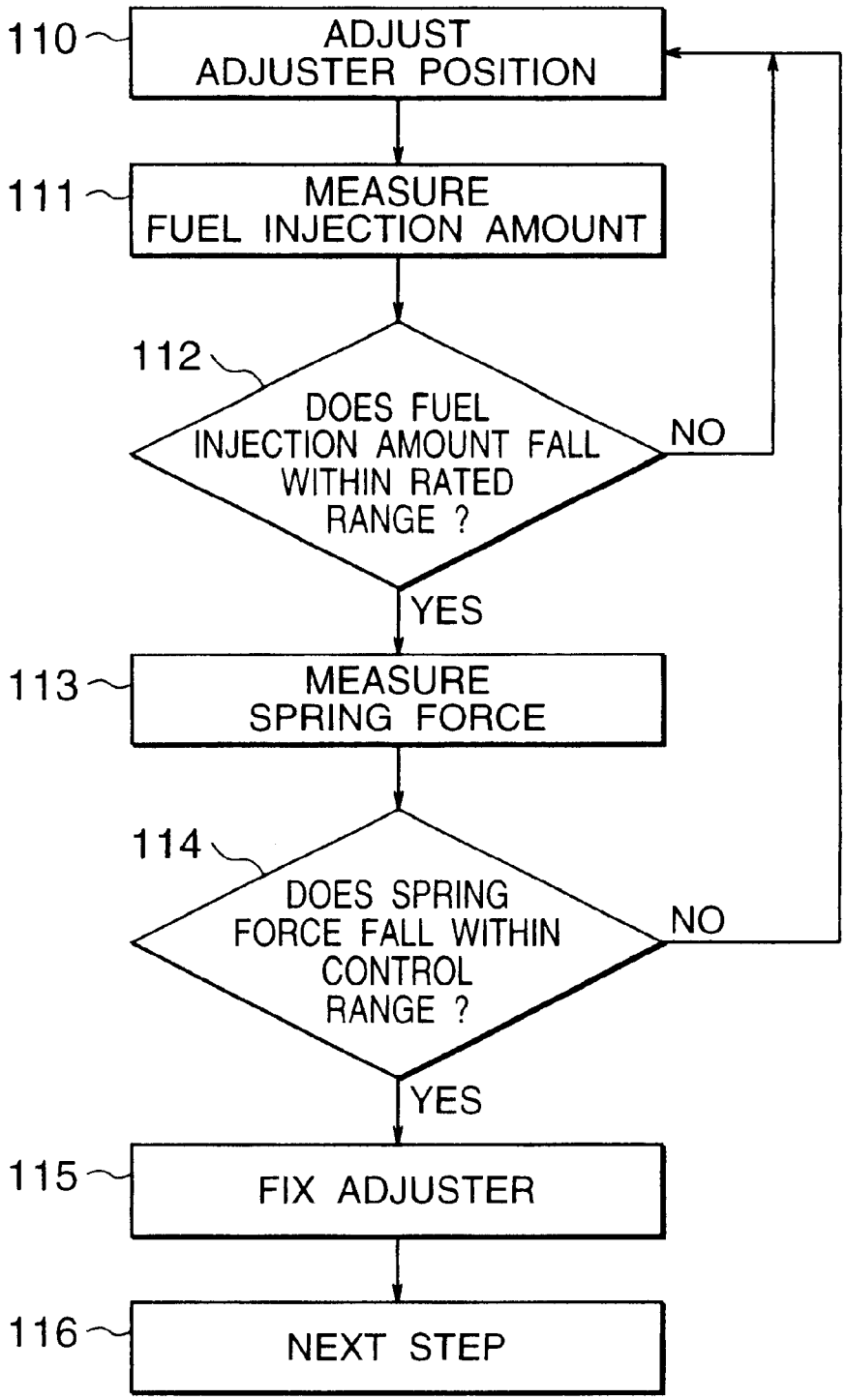
FIG. 1 is a flowchart illustrative of a method for manufacturing a cylinder interior fuel injection valve in accordance with a first embodiment of the present invention.
Figure 2:
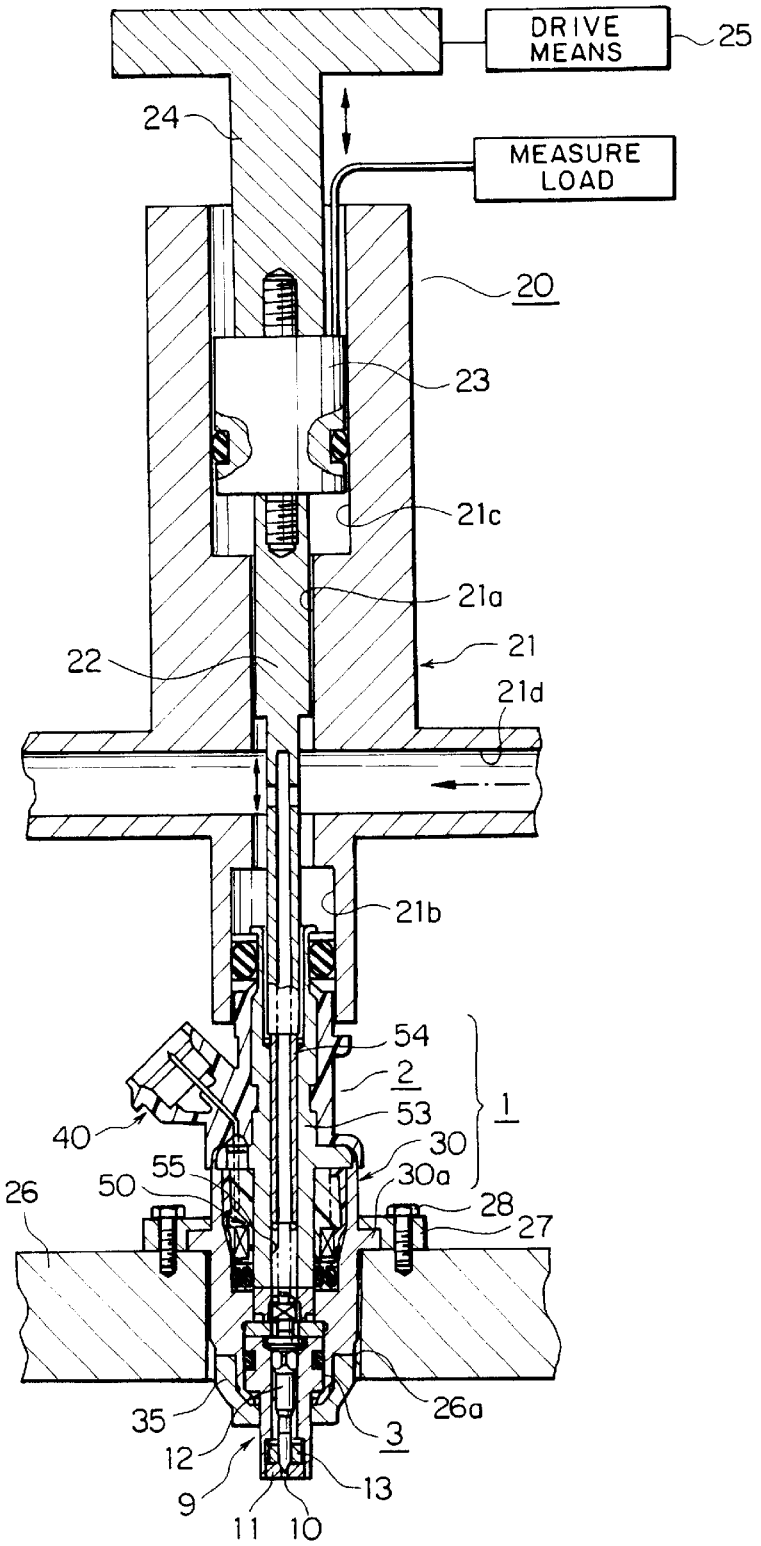
FIG. 2 is a cross-sectional view illustrative of the method for manufacturing the cylinder interior fuel injection valve in accordance with the first embodiment of the present invention.

FIG. 1 is a flowchart illustrative of a manufacturing method of a cylinder interior fuel injection valve in accordance with a first embodiment of the invention. FIG. 2 is a cross-sectional view illustrative of the manufacturing method of the cylinder interior fuel injection valve in accordance with the first embodiment of the invention.

In FIG. 2, a fuel injection amount adjusting apparatus 20 is composed of a body 21 in which a mounting hole 21*b* is provided on a side of an end thereof, a load cell insertion hole 21*c* is provided coaxially with the mounting hole 21*b* on a side of the other end thereof, an adjusting pin insertion hole 21*a* is provided coaxially so as to communicate the mounting hole 21*b* with the load cell insertion hole 21*c* with each other, and a fuel supply passage 21*d* is connected to the mounting hole 21*b*; an adjusting pin 22 which is movably inserted in the axial direction into the adjusting pin insertion hole 21*a* so that the adjusting pin 22 may project from the mounting hole 21*b* on one side thereof and may project into the load cell insertion hole 21*c* on the other side thereof; a load cell 23 connected to the other end of the adjusting pin 22 and movably inserted into the axial direction within the Load cell insertion hole 21*c*; a drive pin 24 connected to the load cell 23 on one side thereof and received in the load cell insertion hole 21*c*; and a drive means 25 including a motor for driving the drive pin 24 or the like.

The method for manufacturing the cylinder interior fuel injection valve according to the first embodiment will now be described with reference to FIGS. 1 and 2.

First of all, after the cylinder interior fuel injection valve 1 is assembled under the condition that the filter 37 is not mounted on the cylinder interior fuel injection valve 1 and the adjuster 54 is not fixed to the core 53, the process moves to the fuel injection amount adjusting step.

In the fuel injection amount adjusting step, as shown in FIG. 2, the tip end side of the cylinder interior fuel injection valve 1 is inserted into a through-hole 26*a* of a base 26, and a retainer jig 27 is applied to a flange 30*a* from above. The retainer jig 27 is fastened and fixed to the base 26 by a fastening bolt 28 so that the cylinder interior fuel injection valve 1 is mounted in place. Furthermore, the fuel injection amount adjusting apparatus 20 is mounted in place so that its mounting hole 21*b* is engaged with a sealing O-ring portion of the upper portion of the housing body 2 of the cylinder interior fuel injection valve 1. Then, the fuel is fed to the cylinder interior fuel injection valve 1 through a fuel supply passage 21*d* as indicated by one-dot-and-dash line in FIG. 2

A drive pin 24 is moved on one side in the axial direction by a predetermined amount by driving a drive means 25. As a result of the movement of the drive pin 24, the adjusting pin 22 is guided by the adjusting pin insertion hole 21*a* and moved by a predetermined amount on one side in the axial direction. The adjuster 54 is guided by the inner circumferential surface of the core 53 and moved on one side in the axial direction by a predetermined amount so that the adjuster 54 is adjusted to a predetermined position (step 110).

Under this condition, a solenoid assembly 50 is operated to inject the fuel from a fuel injection port 10, and the fuel injection amount is measured (step 111). Then, it is judged whether or not the fuel injection amount falls within the rated range (step 112). If the measured fuel injection amount does not fall within the rated range, the process returns back to step 110 to adjust a position of the adjuster 54 again.

In step 112, if the measured fuel injection amount falls within the rated range, the spring force of the valve closing spring 55 in the adjusted position of the adjuster 54 is measured (step 113). At this time, the valve closing spring 55 is compressed by the adjuster 54 and the reactive force caused by the compression amount is applied to the load cell 23 through the adjuster 54 and the adjusting pin 22. The detected value of the load cell 23 is the spring force of the valve closing valve 55.

Then, it is judged whether or not the measured spring force of the valve closing spring 55 falls within a control range between set upper and lower limits (step 114). If the measured spring force is out of the control range, the process returns to step 110 to adjust the position of the adjuster 54 again. In step 114, if the measured spring force falls within the control range, the core 53 is press-fitted and the adjust 54 is fixed (step 115) to finish the fuel injection amount adjusting step. The process moves to the next step (step 116).

The upper and lower limits for limiting the control range of the spring force of the valve closing spring 55 will now be described.

The lower limit of the spring force is set at a value such that the needle valve 12 is closed by the forces in the valve closing direction of the valve closing spring 55 and the fuel pressure and the introduction of the combustion gas into the fuel injection valve 1 may be prevented except for the electric application to the solenoid assembly 50 even if the needle valve 12 serving as a valve body is subjected to the force in the valve opening direction by the combustion gas pressure within the combustion chamber. Namely, when $P_G$ is the pressure of the combustion gas, $P_N$ is the pressure of the fuel, $F_B$ is the force in the valve closing direction by the valve closing spring 55 and A is the seat cross-section area, since the force in the valve opening direction by the pressure of the combustion gas is $A \cdot P_G$, the force in the valve closing direction by the fuel pressure is $A \cdot F_N$, and the force in the valve closing direction by the valve closing valve 55 is $F_B$, in order to meet the above-described condition, it is sufficient that the relationship, $F_B + A \cdot P_N > A \cdot P_G$ is established. Namely, the lower limit $F_{BMIN}$ of the force in the valve closing direction by the valve closing spring 55 is $(A \cdot P_G - A \cdot P_N)$. Then, if the pressure ranges of the combustion gas and the fuel generated in the actual engine are taken into consideration, when $P_{NMIN}$ is the minimum pressure of the fuel which might occur usually and $P_{GMAX}$ is the maximum pressure of the combustion gas which might occur usually, it is sufficient that the lower limit $F_{BMIN}$ of the spring force in the valve closing direction by the valve closing spring 55 is $(A \cdot P_{GMAX} - A \cdot P_{NMIN})$.

On the other hand, the upper limit of the spring force is set at a value such that the needle valve 12 may be opened upon the electric application to the solenoid assembly 50 even if the forces in the valve closing direction by the fuel pressure and the valve closing spring 55 are applied thereto. Namely, when $F_s$ is the magnetic suction force of the solenoid, $F_B$ is the force in the valve closing direction by the valve closing spring 55, $P_N$ is the pressure of the fuel, and A is the seat cross-section area, since the force in the valve opening direction of the solenoid assembly 50 is $F_s$, the force in the valve closing direction by the valve closing valve 55 is $F_B$, and the force in the valve closing direction by the pressure of the fuel is $A \cdot P_N$, in order to meet the above-described condition, it is sufficient that the relationship, $F_S > F_B + A \cdot P_N$ is established. Namely, the upper limit $F_{BMAX}$ of the force in the valve closing direction by the valve closing spring 55 is $(F_S - A \cdot P_N)$. Then, if the pressure range of the combustion gas generated in the actual engine and the non-uniformity of the suction force of the fuel injection valve or its drive assembly are taken into consideration, when $P_{NMAX}$ is the maximum pressure of the fuel which might occur usually and $F_{SMIN}$ is the minimum pressure of the suction force which might occur usually, it is sufficient that the upper limit $F_{NMAX}$ of the spring force in the valve closing direction by the valve closing spring 55 is $(F_{SMIN} - A \cdot P_{NMAX})$.

Incidentally, it is possible to use the values having some allowance for the above-described upper and lower limits of the spring force thus set.

Thus, in the first embodiment, the position of the adjuster 54 is adjusted so that the fuel injection amount falls within the rated range, the spring force of the valve closing spring 55 in the adjusted position of the adjuster 54 is measured, and it is judged whether or not the measured spring force falls within the control range between the set upper and lower limits. Then, in the case where the spring force is out of the control range, the position of the adjuster 54 is adjusted again so that the fuel injection amount falls within the rated range and it is judged again whether or not the spring force in the readjusted position of the adjuster 54 falls within the control range. Then, the above-described operation is repeated until the spring force falls within the control range. After the spring force falls within the control range, the core 53 is press-fitted and the adjuster 54 is fixed in place.

Accordingly, in accordance with the first embodiment, the cylinder interior fuel injection valve 1 is manufactured by adjusting the valve in the fuel injection amount adjusting step so that the fuel injection amount falls within the allowance range of the rated value and the spring force falls in the control range between the set upper and lower limits.

Thus, the fluctuation in fuel pressure and the combustion gas pressure which might occur when the valve is installed in the engine may sufficiently be dealt with. Namely, it is possible to produce the cylinder interior fuel injection valve 1 in which, in the entire region of the fuel pressure range which might occur in the actual engine, the needle valve 12 is not opened even if it receives the force in the valve opening direction by the pressure of the combustion gas upon the non-electric application to the solenoid assembly 50, and over the entire region of the fuel pressure range which might occur in the engine, the needle valve 12 may be opened upon the electric application to the solenoid assembly 50 to inject the fuel.

Also, since the adjustment of the fuel injection amount and the control of the spring force are performed in the fuel injection amount adjusting step, it is possible to reduce the number of the steps and to reduce the cost in comparison with the case where the adjustment of the fuel injection amount and the control of the spring force are performed in other steps.

Also, since it is possible to change the target value of the fuel injection amount within an allowable range of the rated value for the fuel injection amount and to set the spring force between the set upper and lower limits under the condition that the fuel injection amount is adjusted to be the changed target value, it is possible to suppress the non-uniformity of the spring force and to reduce the fault products, i.e. to realize the high yield.

Also, according to the first embodiment, since it is possible to adjust the position of the adjuster 54 by the adjusting pin 22 and to measure the spring force of the valve closing spring 55 in the adjustment position of the adjuster 54 under the condition that the fuel is fed to the cylinder interior fuel injection valve 1 through the fuel supply passage 21*d*, it is possible to obtain the fuel injection amount adjusting apparatus which is applied to the manufacturing method of the cylinder interior fuel injection valve in which the adjustment of the fuel injection amount and the control of the spring force are conducted in the fuel injection amount adjusting step.

EMBODIMENT 2

Figure 3:
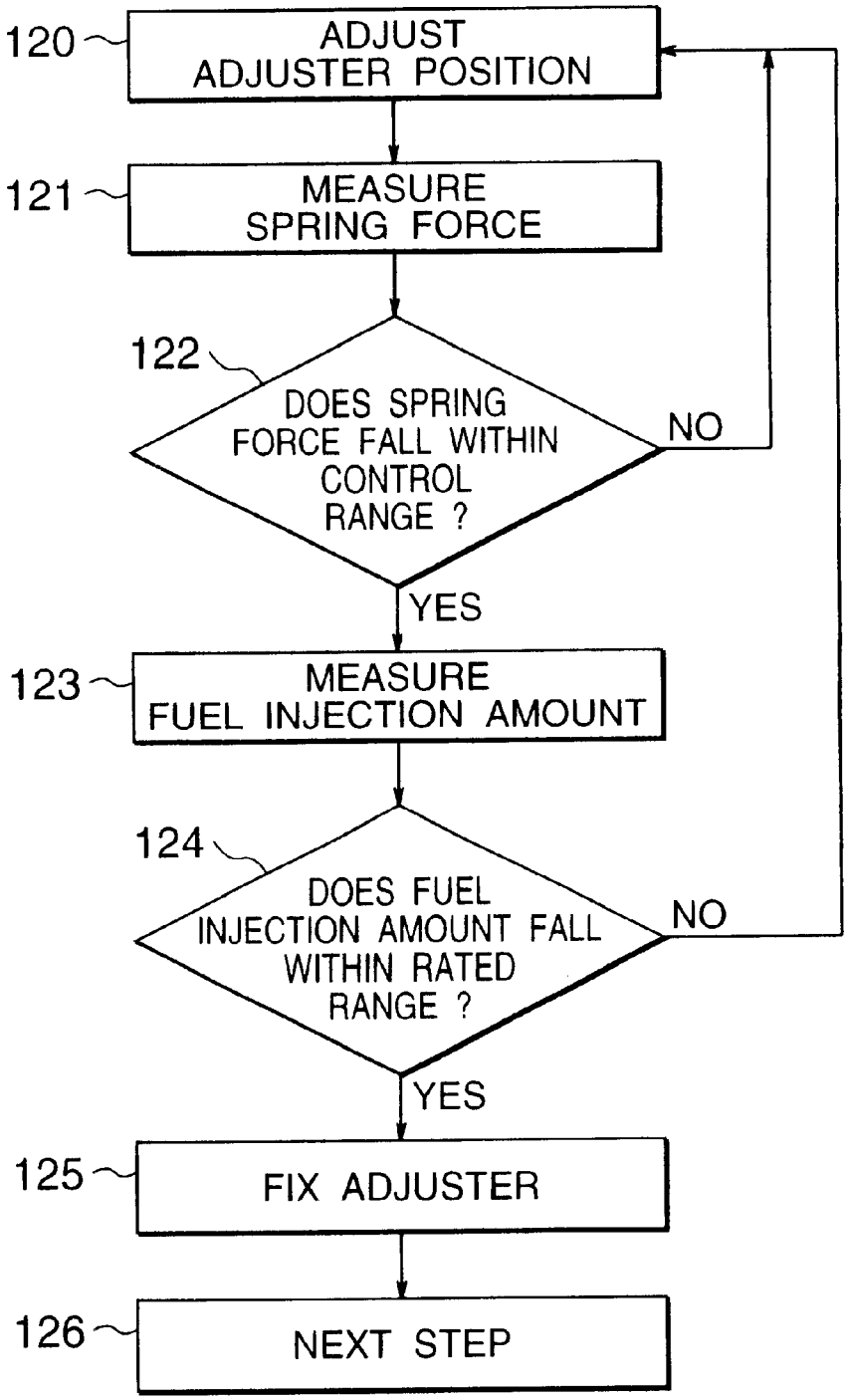
FIG. 3 is a flowchart illustrative of a method for manufacturing a cylinder interior fuel injection valve in accordance with a second embodiment of the present invention.

FIG. 3 is a flowchart illustrative of a manufacturing method of a cylinder interior fuel injection valve in accordance with a second embodiment of the invention.

The manufacturing method of the cylinder interior fuel injection valve in accordance with the second embodiment will now be described with reference to FIG. 3.

First of all, after the cylinder interior fuel injection valve 1 is assembled under the condition that the filter 37 is not mounted on the cylinder interior fuel injection valve 1 and the adjuster 54 is not fixed to the core 53, the process moves to the fuel injection amount adjusting step.

In the fuel injection amount adjusting step, as shown in FIG. 2, the tip end side of the cylinder interior fuel injection valve 1 is inserted into a through-hole 26*a* of a base 26, and a retainer jig 27 is applied to a flange 30*a* from above. The retainer jig 27 is fastened and fixed to the base 26 by the fastening bolt 28 so that the cylinder interior fuel injection valve 1 is mounted in place. Furthermore, the fuel injection amount adjusting apparatus 20 is mounted in place so that its mounting hole 21*b* is engaged with a sealing O-ring portion of the upper portion of the housing body 2 of the cylinder interior fuel injection valve 1. Then, the fuel is fed to the cylinder interior fuel injection valve 1 through a fuel supply passage 21*d*.

A drive pin 24 is moved on one side in the axial direction by a predetermined amount by driving a drive means 25. As a result of the movement of the drive pin 24, the adjusting pin 22 is guided by the adjusting pin insertion hole 21*a* and moved by a predetermined amount in one side in the axial direction. The adjuster 54 is guided by the inner circumferential surface of the core 53 and moved on one side in the axial direction by a predetermined amount so that the adjuster 54 is adjusted to a predetermined position (step 120).

The spring force of the valve closing spring 55 in the adjusted position of the adjuster 54 is measured (step 121). At this time, the valve closing spring 55 is compressed by the adjuster 54, and the repulsive force caused by the compression amount is applied to the load cell 23 through the adjuster 54 and the adjusting pin 22, and the detected value of the load cell 23 is the spring force of the valve closing spring 55.

Then, it is judged whether or not the measured spring force of the valve closing spring 55 falls within the control range between the upper and lower limits (step 122). If the measured spring force is out of the control range, the process returns back to the step 120 to adjust the position of the adjuster 54 again.

If, in step 122, the measured spring force falls within the control range, under this condition, the solenoid assembly 50 is operated to inject the fuel from the fuel injection port 10 and the fuel injection amount thereof is measured (step 123). Then, it is judged whether or not the fuel injection amount falls within the rated range (step 124). If the fuel injection amount is out of the rated range, the process returns to the step 120 and the position adjustment of the adjuster 54 is performed again.

In the step 124, if the measured fuel injection amount falls within the rated range, the core 53 is press-fitted and the adjuster 54 is fixed (step 125) and the adjustment step for the fuel injection amount is finished. The process moves to the next step (step 126).

Thus, in the second embodiment, the position of the adjuster 54 is adjusted so that the spring force of the valve closing spring 55 falls within the control range between the upper and lower limits, the fuel injection amount in the adjusted position of the adjuster 54 is measured, and it is judged whether or not the measured fuel injection amount falls within the rated range. Then, in the case where the fuel injection amount does not fall within the rated range, the position of the adjuster 54 is adjusted again so that the spring force falls within the range between the upper and lower limits, and it is judged again whether or not the fuel injection amount in the readjusted position of the adjuster 54 falls within the rated range. Then, the above-described operation is repeated until the fuel injection amount falls within the rated range. After the fuel injection amount falls within the rated range, the core 53 is press-fitted and the adjuster 54 is fixed in place.

Accordingly, in accordance with the second embodiment, the cylinder interior fuel injection valve 1 is manufactured by adjusting the valve in the fuel injection amount adjusting step so that the spring force falls within the control range between the set upper and lower limits and the fuel injection amount falls within the allowance range of the rated value.

Thus, the fluctuation in fuel pressure and the combustion gas pressure which might occur when the valve is installed in the engine may sufficiently be dealt with. Namely, it is possible to produce the cylinder interior fuel injection valve 1 in which, in the entire region of the fuel pressure range which might occur in the actual engine, the needle valve 12 is not opened even if it receives the force in the valve opening direction by the pressure of the combustion gas upon the non-electric application to the solenoid assembly 50, and over the entire region of the fuel pressure range which might occur in the engine, the needle valve 12 may be opened upon the electric application to the solenoid assembly 50 to inject the fuel.

Also, since the adjustment of the fuel injection amount and the control of the spring force are performed in the fuel injection amount adjusting step, it is possible to reduce the number of the steps and to reduce the cost in comparison with the case where the adjustment of the fuel injection amount and the control of the spring force are performed in other steps. Also, since it is possible to change the target value of the spring force within the control range of the spring force and to set the fuel injection amount between the allowable range of the rated value under the condition that the spring force is controlled to be the changed target value, it is possible to suppress the non-uniformity of the spring force and to reduce the fault products, i.e. to realize the high yield.

EMBODIMENT 3

In the first embodiment, in the fuel injection amount adjusting step, the target value of the fuel injection amount is changed within an allowable range of the rated value for the fuel injection amount and the spring force of the valve closing spring 55 is set between the set upper and lower limits under the condition that the fuel injection amount is adjusted to be the changed target value. However, in this third embodiment, in the fuel injection amount adjusting step, the target value of the fuel injection amount is changed within the allowable range of the rated value for the fuel injection amount and the spring force of the valve closing spring 55 is controlled to be equal to or greater than the set lower limit under the condition that the fuel injection amount is adjusted to be the changed target value.

Accordingly, in accordance with the third embodiment, the cylinder interior fuel injection valve 1 is manufactured so that the fuel injection amount falls within the allowance range of the rated value and the spring force is set to be equal to or greater than the lower limit. Therefore, it is possible to produce the cylinder interior fuel injection valve 1 in which, in the entire region of the fuel pressure range which might occur in the actual engine, the needle valve 12 is not opened even if it receives the force in the valve opening direction by the pressure of the combustion gas upon the non-electric application to the solenoid assembly 50.

EMBODIMENT 4

In the first embodiment, in the fuel injection amount adjusting step, the target value of the fuel injection amount is changed within an allowable range of the rated value for the fuel injection amount and the spring force of the valve closing spring 55 is set between the set upper and lower limits under the condition that the fuel injection amount is adjusted to be the changed target value. However, in the fourth embodiment, in the fuel injection amount adjusting step, the target value of the fuel injection amount is changed within the allowable range of the rated value for the fuel injection amount and the spring force of the valve closing spring 55 is controlled to be equal to or smaller than the set upper limit under the condition that the fuel injection amount is adjusted to be the changed target value.

Accordingly, in accordance with the fourth embodiment, the cylinder interior injection fuel injection valve 1 is manufactured by so that the fuel injection amount falls within the allowance range of the rated value and the spring force is set to be equal to or smaller than the upper limit. Therefore, it is possible to produce the cylinder interior fuel injection valve 1 in which, over the entire region of the fuel pressure range which might occur in the engine, the needle valve 12 may be opened upon the electric application to the solenoid assembly 50 to inject the fuel.

EMBODIMENT 5

In the first embodiment, in the fuel injection amount adjusting step, the spring force of the valve closing spring 55 is changed between the set upper and lower limits and the fuel injection amount is controlled within the allowance range of the rated value under the condition that the spring force is controlled to be the changed value. However, in the fifth embodiment, in the fuel injection amount adjusting step, the spring force of the valve closing spring 55 is changed to be equal to or greater than the set lower limit and the fuel injection amount is controlled within the allowance range of the rated value under the condition that the spring force is controlled to be the changed value.

Accordingly, in accordance with the fifth embodiment, the cylinder interior fuel injection valve 1 is manufactured so that the fuel injection amount falls within the allowable range of the rated value and the spring force is equal to or greater than the set lower limit value. Therefore, it is possible to produce the cylinder interior fuel injection valve 1 in which, in the entire region of the fuel pressure range which might occur in the actual engine, the needle valve 12 is not opened even if it receives the force in the valve opening direction by the pressure of the combustion gas upon the non-electric application to the solenoid assembly 50.

EMBODIMENT 6

In the second embodiment, in the fuel injection amount adjusting step, the spring force of the valve closing spring 55 is changed between the set upper and lower limits and the fuel injection amount is controlled within the allowance range of the rated value under the condition that the spring force is controlled to be the changed value. However, in the sixth embodiment, in the fuel injection amount adjusting step, the spring force of the valve closing spring 55 is changed to be equal to or smaller than the set upper limit and the fuel injection amount is controlled within the allowance range of the rated value under the condition that the spring force is controlled to be the changed value.

Accordingly, in accordance with the sixth embodiment, the cylinder interior fuel injection valve 1 is manufactured by adjusting the valve so that the fuel injection amount falls within the allowable range of the rated value and the spring force is equal to or greater than the set lower limit value. Therefore, it is possible to produce the cylinder interior fuel injection valve 1 in which, over the entire region of the fuel pressure range which might occur in the engine, the needle valve 12 may be opened upon the electric application to the solenoid assembly 50 to inject the fuel.

EMBODIMENT 7

In the foregoing first embodiment, in the fuel injection amount adjusting step, the fuel injection amount is adjusted and the spring force is controlled. In the seventh embodiment, the fuel injection amount is adjusted, the core 53 is press-fitted to fix the adjuster 54. After the fuel injection amount adjusting step is finished, the spring force is controlled.

Figure 4:
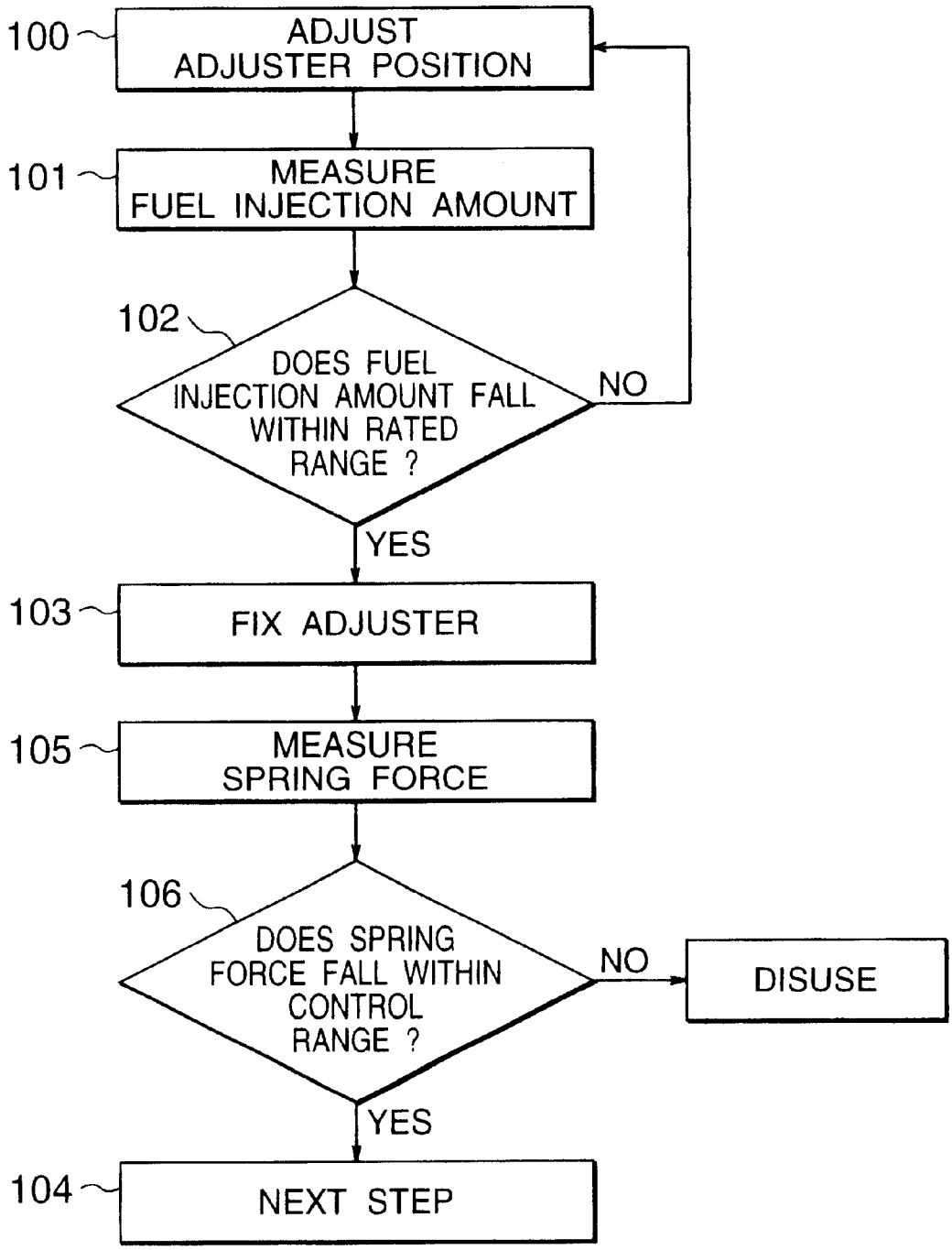
FIG. 4 is a flowchart illustrative of a method for manufacturing a cylinder interior fuel injection valve in accordance with a seventh embodiment of the present invention.
Figure 5:
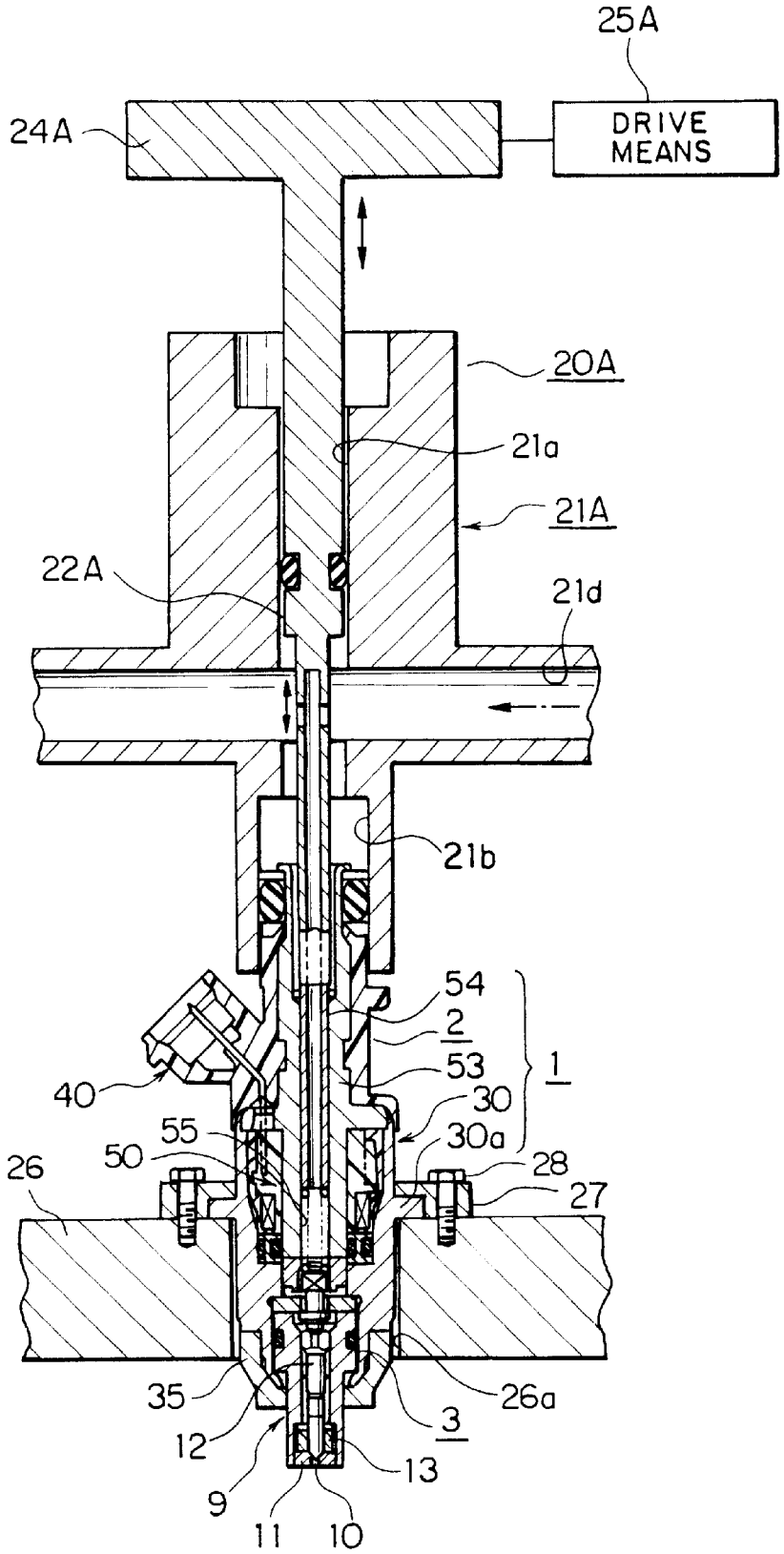
FIG. 5 is a cross-sectional view illustrative of the method for manufacturing the cylinder interior fuel injection valve in accordance with the seventh embodiment of the present invention.
Figure 6:
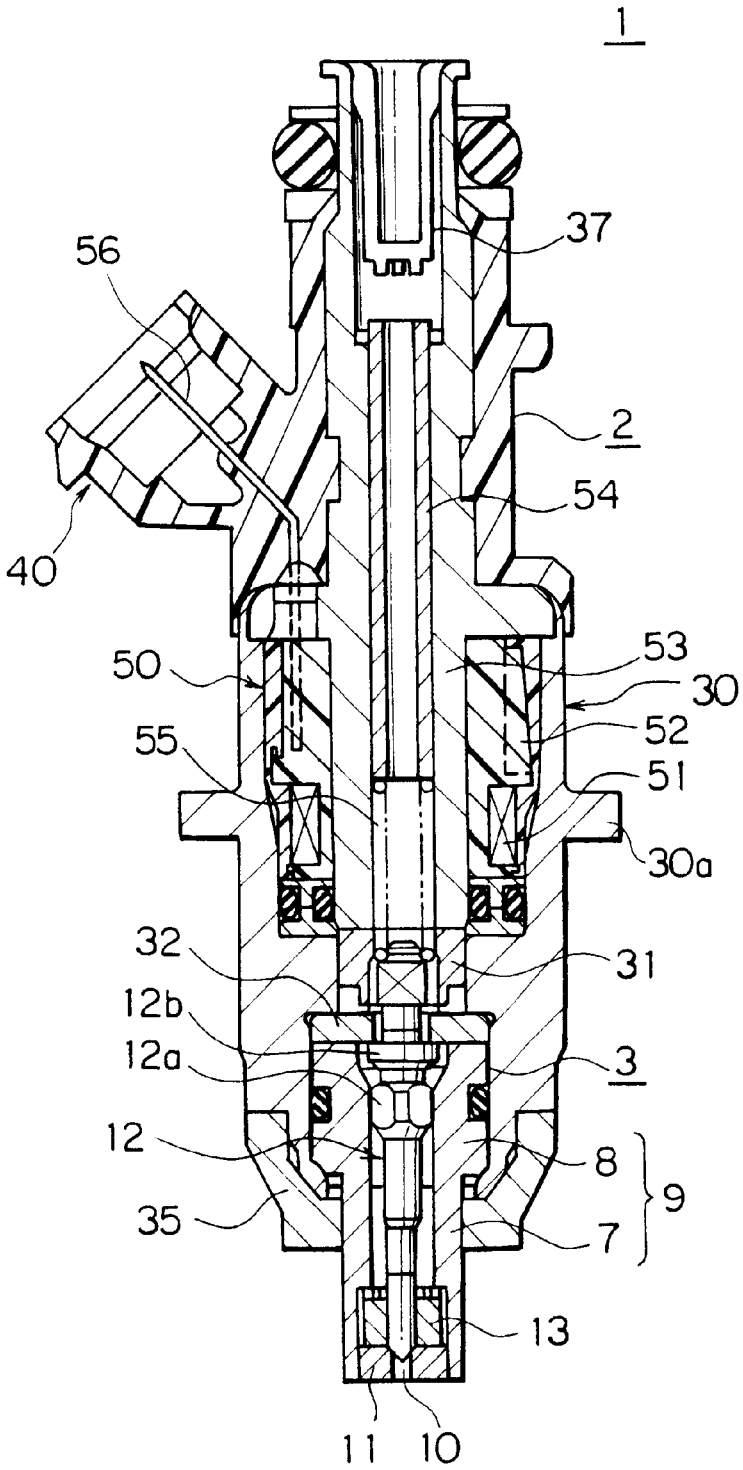
FIG. 6 PRIOR ART
FIG. 6 is a cross-sectional view showing a cylinder interior fuel injection valve.
Figure 7:
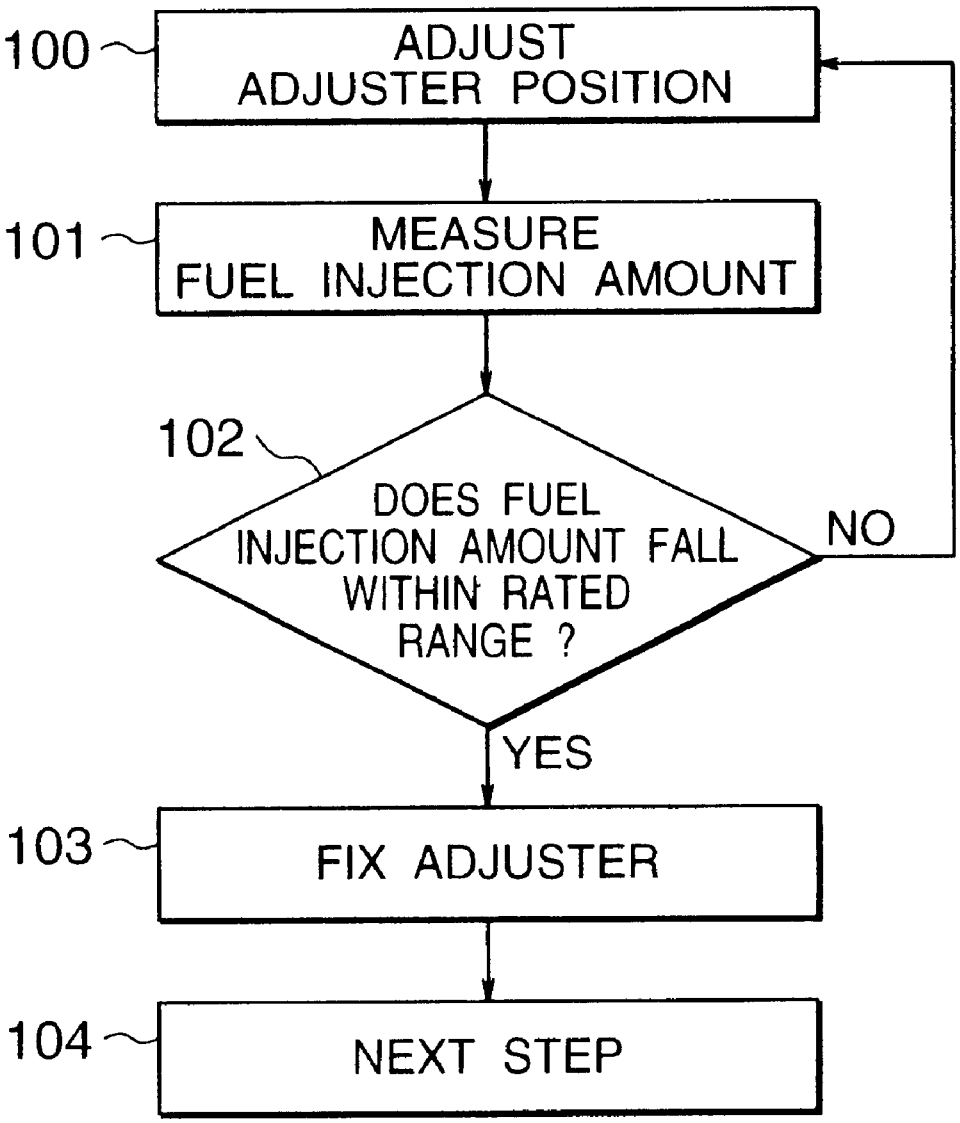
FIG. 7 PRIOR ART
FIG. 7 is a flowchart illustrative of a conventional method for manufacturing a cylinder interior fuel injection valve.
Figure 8:
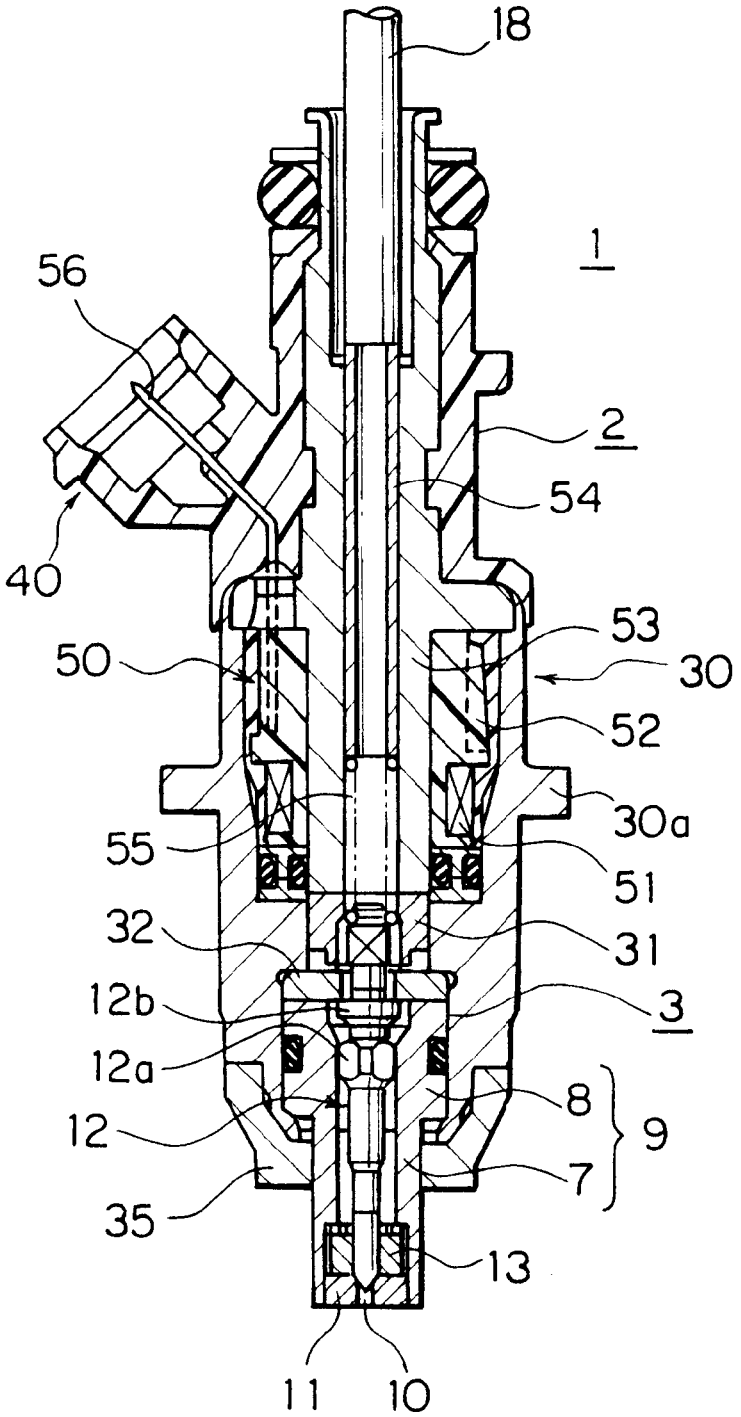
FIG. 8 PRIOR ART
FIG. 8 is a cross-sectional view illustrative of the conventional method for manufacturing the cylinder interior fuel injection valve.

FIG. 4 is a flowchart illustrative of a manufacturing method of a cylinder interior fuel injection valve in accordance with the seventh embodiment of the invention. FIG. 5 is a cross-sectional view illustrative of the manufacturing method of the cylinder interior fuel injection valve in accordance with the seventh embodiment of the invention.

In FIG. 5, a fuel injection amount adjusting apparatus 20A is composed of a body 21A in which an adjusting pin insertion hole 21*a* is provided thereon, a mounting hole 21*b* is provided coaxially on a side of an end of the adjusting pin insertion hole 21*a* and a fuel supply passage 21*d* is connected to the mounting hole 21*b*; an adjusting pin 22A which is movably inserted in the axial direction into the adjusting pin insertion hole 21*a* so that the adjusting pin 22A may project from the mounting hole 21*b* on one side thereof; a drive pin 24A connected to the other end of the adjustment pin 22A; and a drive means 25A including a motor for driving the drive pin 24A or the like.

The method for manufacturing the cylinder interior fuel injection valve according to the seventh embodiment will now be described with reference to FIGS. 4 and 5.

First of all, after the cylinder interior fuel injection valve 1 is assembled under the condition that the filter 37 is not mounted on the cylinder interior fuel injection valve 1 and the adjuster 54 is not fixed to the core 53, the process moves to the fuel injection amount adjusting step.

In the fuel injection adjusting step, as shown in FIG. 5, the tip end side of the cylinder interior fuel injection valve 1 is inserted into a through-hole 26*a* of a base 26, and a retainer jig 27 is applied to a flange 30*a* from above. The retainer jig 27 is fastened and fixed to the base 26 by the fastening bolt 28 so that the cylinder interior fuel injection valve 1 is mounted in place. Furthermore, the fuel injection amount adjusting apparatus 20A is mounted in place so that its mounting hole 21*b* is engaged with a sealing O-ring portion of the upper portion of the housing body 2 of the cylinder interior fuel injection valve 1. Then, the fuel is fed to the cylinder interior fuel injection valve 1 through a fuel supply passage 21*d*.

A drive pin 24A is moved on one side in the axial direction by a predetermined amount by driving a drive means 25A. As a result of the movement of the drive pin 24A, the adjusting pin 22A is guided by the adjusting pin insertion hole 21*a* and moved by a predetermined amount on one side in the axial direction. The adjuster 54 is guided by the inner circumferential surface of the core 53 and moved on one side in the axial direction by a predetermined amount so that the adjuster 54 is adjusted to a predetermined position (step 100).

Under this condition, a solenoid assembly 50 is operated to inject the fuel from a fuel injection port 10, and the fuel injection amount is measured (step 101). Then, it is judged whether or not the fuel injection amount falls within the rated range (step 102). If the measured fuel injection amount falls within the rated range, the core 53 is press-fitted from the outside to fix the adjuster 54 to the core 53 (step 103). Thus, the fuel injection amount adjusting process is finished to move to the control step of spring force. In step 102, if the measured fuel injection amount does not fall within the rated range, the process returns back to the step 100 and readjust the position of the adjuster 54 so that the fuel injection amount falls within the range of the rated value.

A detection terminal of a load cell is inserted from the fuel injection port 10 into the cylinder interior fuel injection valve 1 which the adjuster 54 is fixed to the core 53 after the completion of the fuel injection amount adjusting step, and is depressed to a tip end of the needle valve 12, and the spring force of the valve closing spring 55 is measured (step 105). Then, it is judged whether or not the measured value of the spring force falls within the control range between the set upper and lower limits (step 106). If the measured spring force is out of the control range, the valve is discarded (or reassembled). Namely, only the cylinder interior fuel injection valve 1 whose spring force of the valve closing valve 55 falls within the set upper and lower limits is sent to the next step (step 104).

Thus, in the seventh embodiment, the adjuster 54 is fixed to the core 53 under the condition that the fuel injection amount is adjusted in position so that it falls within the rated range. After the completion of the fuel injection amount adjusting step, the control step of the spring force of the valve closing spring 55 is carried out. The cylinder interior fuel injection valve 1 is screened so that the spring force falls within the control range between the set upper and lower limits. Accordingly, it is possible to produce the cylinder interior fuel injection valve 1 in which, in the entire region of the fuel pressure range which might occur in the actual engine, the needle valve 12 is not opened even if it receives the force in the valve opening direction by the pressure of the combustion gas upon the non-electric application to the solenoid assembly 50, and over the entire region of the fuel pressure range which might occur in the engine, the needle valve 12 may be opened upon the electric application to the solenoid assembly 50.

EMBODIMENT 8

In the seventh embodiment, the adjuster 54 is fixed to the core 53 under the condition that the fuel injection amount is adjusted in position so that it falls within the rated range. After the completion of the fuel injection amount adjusting step, the control step of the spring force of the valve closing spring 55 as to whether or not the spring force falls within the control range between the set upper and lower limits is carried out. In the eighth embodiment, after the adjuster 54 is fixed to the core 53 under the condition that the fuel injection amount is adjusted in position so that it falls within the rated range and the fuel injection amount adjusting step is finished, the control step of the spring force of the valve closing spring 55 as to whether or not the spring force falls within the control range equal to or greater than the set lower limit is carried out.

Accordingly, in accordance with the eighth embodiment, since the spring force is controlled so that the spring force is equal to or greater than the set lower limit for the cylinder interior fuel injection valve 1 whose fuel injection amount falls within the rated ranges, in the entire region of the fuel pressure range which might occur in the actual engine, the needle valve 12 is closed upon the non-electric application to the solenoid assembly 50.

EMBODIMENT 9

In the seventh embodiment, the adjuster 54 is fixed to the core 53 under the condition that the fuel injection amount is adjusted in position so that it falls within the rated range. After the completion of the fuel injection amount adjusting step, the control step of the spring force of the valve closing spring 55 as to whether or not the spring force falls within the control range between the set upper and lower limits is carried out. In the ninth embodiment, after the adjuster 54 is fixed to the core 53 under the condition that the fuel injection amount is adjusted in position so that it falls within the rated range and the fuel injection amount adjusting step is finished, the control step of the spring force of the valve closing spring 55 as to whether or not the spring force falls within the control range equal to or lower than the set upper limit is carried out.

Accordingly, in accordance with the ninth embodiment, since the spring force is controlled so that the spring force is equal to or smaller than the set upper limit for the cylinder interior fuel injection valve 1 whose fuel injection amount falls within the rated ranges, over the entire region of the fuel pressure range which might occur in the engine, the needle valve 12 may be opened upon the electric application to the solenoid assembly 50 whose fuel injection amount falls within the rated ranges.

According to the present invention, the valve is thus constructed and ensures the following advantages.

According to the present invention, a manufacturing method for a cylinder interior fuel injection valve composed of, a housing having a fuel passage along an axis, a valve assembly having a valve seat provided with a fuel injection port and a valve body for contacting with or separating from the valve seat to open/close the fuel injection port and fixed to one end of the housing so as to project a side of the fuel injection port, a solenoid assembly installed in the housing for magnetically sucking the valve body in a valve opening direction, a valve closing spring received in the fuel passage of the housing for biasing the valve body in a valve closing direction, and an adjuster fixed to the fuel passage of the housing for depressing the valve closing spring toward the valve seat; the method comprising the steps of: adjusting the position of the adjuster in the fuel passage of the housing so that a fuel injection amount may fall within a range of a rated value of the fuel injection amount and a spring force of the valve closing spring may fall within a set control range of the spring force; and fixing the adjuster which has been adjusted in position to the housing. Accordingly, it is possible to ensure the method for manufacturing a cylinder interior fuel injection valve which may sufficiently cope with a fluctuation in fuel pressure or combustion gas pressure that would occur in an actual engine and realize a high yield.

Also, the manufacturing method comprising: an adjuster position adjusting step for measuring the fuel injection amount while changing positions in axial direction of the adjuster within the fuel passage of the housing and and adjusting the adjuster position so that the measured value may fall within a range of a rated value of the fuel injection amount; a judging step for measuring the spring force of the valve closing spring in the adjuster position adjusted in the adjuster position adjusting step, judging whether or not the measured value falls within a set control range of the spring force, and re-executing the adjuster position adjusting step in the case where the measured value is out of the set control range of the spring force; and an adjuster fixing step for fixing the adjuster to the housing in the case where the measured value of the spring force of the valve closing spring falls within the set control range of the spring force in the judging step. Accordingly, the adjustment of the fuel injection amount and the control of the spring force of the valve closing spring are carried out in the single step so that it is possible to reduce the number of the steps and the cost.

Also, the manufacturing method comprising: an adjuster position adjusting step for measuring a spring force of the valve closing spring while changing an axial position of the adjuster within the fuel passage of the housing and for adjusting the position of the adjuster so that the measured value thereof falls within a set control range of the spring force; a judging step for measuring the fuel injection amount in the adjuster position adjusted in the adjuster position adjusting step, judging whether or not the measured value falls within a range of a rated value of the fuel injection amount, and re-executing the adjuster position adjusting step in the case where the measured value is out of the rated value of the fuel injection amount; and an adjuster fixing step for fixing the adjuster to the housing in the case where the measured value of the fuel injection amount falls within the range of the rated value in the judging step. Accordingly, the adjustment of the fuel injection amount and the control of the spring force of the valve closing spring are carried out in the single step so that it is possible to reduce the number of the steps and the cost.

Also, the spring force is controlled so as to fall within a control range between a lower limit at which the valve opening caused by the combustion gas pressure of a combustion chamber is prevented and the valve closing condition may be maintained when the solenoid assembly is not electrically excited in an actual engine installation and an upper limit at which the valve opening condition may be maintained upon the electric excitation of the solenoid assembly in a range of the fuel pressure that may occur in an actual engine. It is therefore possible to produce the cylinder interior fuel injection valve in which, in the entire region of the fuel pressure range which might occur in the actual engine, the valve body is not opened even if it receives the force in the valve opening direction by the pressure of the combustion gas upon the non-electric application to the solenoid assembly, and over the entire region of the fuel pressure range which might occur in the actual engine, the valve body may be opened upon the electric application to the solenoid assembly to inject the fuel.

Also, the spring force is controlled so as to fall within a control range equal to or greater than a lower limit at which the valve opening caused by combustion gas of a combustion chamber is prevented and the valve closing condition may be maintained when the solenoid assembly is not electrically excited in an actual engine installation. It is therefore possible to produce the cylinder interior fuel injection valve in which, in the entire region of the fuel pressure range which might occur in the actual engine, the valve body is not opened to prevent the combustion gas entering the cylinder interior fuel injection valve even if it receives the force in the valve opening direction by the pressure of the combustion gas upon the non-electric application to the solenoid assembly.

Also, the spring force is controlled so as to fall within a control range equal to or lower than an upper limit at which the valve opening condition may be maintained upon the electric excitation of the solenoid assembly in a range of the fuel pressure that may occur in an actual engine. It is therefore possible to produce the cylinder interior fuel injection valve in which, over the entire region of the fuel pressure range which might occur in the engine, the valve body may be opened upon the electric application to the solenoid assembly to inject the fuel.

Also, according to the invention, a fuel injection amount adjusting apparatus for a cylinder interior fuel injection valve composed of, a housing having a fuel passage along an axis, a valve assembly having a valve seat provided with a fuel injection port and a valve body for contacting with or separating from the valve seat to open/close the fuel injection port and fixed to one end of the housing so as to project on a side of the fuel injection port, a solenoid assembly installed in the housing for magnetically sucking the valve body in a valve opening direction, a valve closing spring received in the fuel passage of the housing for biasing the valve body in a valve closing direction, and an adjuster inserted into the fuel passage of the housing for depressing the valve closing spring toward the valve seat; the fuel injection amount adjusting apparatus comprising: a body having a mounting hole provided on one end side thereof, a load cell insertion hole provided coaxially with the mounting hole on the other end side thereof, an adjusting pin insertion hole provided coaxially for communicating the mounting hole and the load cell insertion hole with each other and a fuel supply passage communicated with the mounting hole; an adjusting pin received movably in an axial direction in the adjusting pin insertion hole with one end projecting from the mounting hole and the other end projecting into the load cell insertion hole for adjusting a position of the adjuster; a load cell received in the load cell insertion hole with one end connected to the other end of the adjusting pin; a drive pin received in the load cell insertion hole with one end connected to the other end of the load cell; and a drive means for reciprocating the drive pin in the axial direction, wherein the body is mounted on the housing under the condition that the other end side of the housing is inserted into the mounting hole and the fuel may be supplied to the fuel passage of the housing through the fuel supply passage, and the drive pin is moved in the axial direction by the drive means so that the movement force of the drive pin is transmitted to the adjuster through the load cell and the adjusting pin to compress the valve closing spring, whereby the fuel injection amount to be determined in response to the spring force of the valve closing spring being adjusted and a repulsive force of the valve closing spring to be applied to the load cell being measured as the spring force of the valve closing valve by the load cell. Accordingly, it is possible to the fuel injection amount adjusting apparatus for the cylinder interior fuel injection valve that may readily perform the adjustment of the fuel injection amount and the control of the spring force of the valve closing valve in the fuel injection amount adjusting step.

Also, according to this invention, a manufacturing method for a cylinder interior fuel injection valve composed of, a housing having a fuel passage along an axis, a valve assembly having a valve seat provided with a fuel injection port and a valve body for contacting with or separating from the valve seat to open/close the fuel injection port and fixed to one end of the housing so as to project a side of the fuel injection port, a solenoid assembly installed in the housing for magnetically sucking the valve body in a valve opening direction, a valve closing spring received in the fuel passage of the housing for biasing the valve body in a valve closing direction, and an adjuster fixed to the fuel passage of the housing for depressing the valve closing spring toward the valve seat; the manufacturing method comprising the steps of: measuring a fuel injection amount by changing positions in axial direction of the adjuster within the fuel passage of the housing and adjusting the position of the adjuster so that the measured value thereof may fall within a range of a rated value of the fuel injection amount; fixing the adjuster which has been adjusted in position to the housing; and measuring the spring force of the valve closing spring after the adjuster is fixed to the housing and judging whether or not the measured value falls within a control range of the spring force. Accordingly, it is possible to ensure the method for manufacturing a cylinder interior fuel injection valve which may sufficiently cope with a fluctuation in fuel pressure or combustion gas pressure that would occur in an actual engine to realize a high yield.

Also, the spring force is controlled so as to fall within a control range between a lower limit at which the valve opening caused by the combustion gas pressure of a combustion chamber is prevented and the valve closing condition may be maintained when the solenoid assembly is not electrically excited in an actual engine installation and an upper limit at which the valve opening condition may be maintained upon the electric excitation of the solenoid assembly in a range of the fuel pressure that may occur in an actual engine. It is therefore possible to produce the cylinder interior fuel injection valve in which, in the entire region of the fuel pressure range which might occur in the actual engine, the valve body is not opened even if it receives the force in the valve opening direction by the pressure of the combustion gas upon the non-electric application to the solenoid assembly, and over the entire region of the fuel pressure range which might occur in the engine, the valve body may be opened upon the electric application to the solenoid assembly to inject the fuel.

Also, the spring force is controlled so as to fall within a control range equal to or greater than a lower limit at which the valve opening caused by the combustion gas pressure of a combustion chamber is prevented and the valve closing condition may be maintained when the solenoid assembly is not electrically excited in an actual engine installation. It is therefore possible to produce the cylinder interior fuel injection valve in which, in the entire region of the fuel pressure range which might occur in the actual engine, the valve body is not opened to prevent the combustion gas entering the cylinder interior fuel injection valve even if it receives the force in the valve opening direction by the pressure of the combustion gas upon the non-electric application to the solenoid assembly.

Also, the spring force is controlled so as to fall within a control range equal to or lower than an upper limit at which the valve opening condition may be maintained upon the electric excitation of the solenoid assembly in a range of the fuel pressure that may occur in an actual engine. It is therefore possible to produce the cylinder interior fuel injection valve in which over the entire region of the fuel pressure range which might occur in the engine, the valve body may be opened upon the electric application to the solenoid assembly to inject the fuel.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed is:

1. A manufacturing method for a cylinder interior fuel injection valve composed of, a housing having a fuel passage along an axis, a valve assembly having a valve seat provided with a fuel injection port and a valve body for contacting with or separating from said valve seat to open/close said fuel injection port and fixed to one end of said housing so as to project a side of said fuel injection port, a solenoid assembly installed in said housing for magnetically sucking said valve body in a valve opening direction, a valve closing spring received in the fuel passage of said housing for biasing said valve body in a valve closing direction, and an adjuster fixed to the fuel passage of said housing for depressing said valve closing spring toward said valve seat thereby simultaneously to set both a fuel injection amount and a spring force of the valve closing spring;

said manufacturing method comprising the steps of:

adjusting the position of said adjuster in the fuel passage of said housing so that both a fuel injection amount falls within a range of a rated value of the fuel injection amount and a spring force of said valve closing spring falls within a set control range of the spring force; and fixing said adjuster which has been adjusted in position to said housing.

2. The manufacturing method for a cylinder interior fuel injection valve according to claim 1, wherein the spring force is controlled so as to fall within a control range between a lower limit at which the valve opening caused by the combustion gas pressure of a combustion chamber is prevented and the valve closing condition may be maintained when said solenoid assembly is not electrically excited in an actual engine installation and an upper limit at which the valve opening condition may be maintained upon the electric excitation of said solenoid assembly in a range of the fuel pressure that may occur in an actual engine.

3. The manufacturing method for a cylinder interior fuel injection valve according to claim 1, wherein the spring force is controlled so as to fall within a control range equal to or greater than a lower limit at which the valve opening caused by the combustion gas pressure of a combustion chamber is prevented and the valve closing condition may be maintained when said solenoid assembly is not electrically excited in an actual engine installation.

4. The manufacturing method for a cylinder interior fuel injection valve according to claim 1, wherein the spring force is controlled so as to fall within a control range equal to or lower than an upper limit at which the valve opening condition may be maintained upon the electric excitation of said solenoid assembly in a range of the fuel pressure that may occur in an actual engine.

5. A manufacturing method for a cylinder interior fuel injection valve composed of, a housing having a fuel passage along an axis, a valve assembly having a valve seat provided with a fuel injection port and a valve body for contacting with or separating from said valve seat to open/close said fuel injection port and fixed to one end of said housing so as to project a side of said fuel injection port, a solenoid assembly installed in said housing for magnetically sucking said valve body in a valve opening direction, a valve closing spring received in the fuel passage of said housing for biasing said valve body in a valve closing direction, and an adjuster fixed to the fuel passage of said housing for depressing said valve closing spring toward said valve seat;

said manufacturing method comprising the steps of:

adjusting the position of said adjuster in the fuel passage of said housing so that a fuel injection amount falls within a range of a rated value of the fuel injection amount and a spring force of said valve closing spring falls within a set control range of the spring force, wherein said adjusting step includes:

an adjuster position adjusting step for measuring the fuel injection amount while changing axial positions of said adjuster within the fuel passage of said housing and adjusting the adjuster position so that the measured value falls within a range of a rated value of the fuel injection amount; and a judging step for measuring the spring force of said valve closing spring in the adjuster position adjusted in said adjuster position adjusting step, judging whether or not the measured value falls within a set control range of the spring force and re-executing said adjuster position adjusting step in the case where the measured value is out of the set control range of the spring force; and fixing said adjuster which has been adjusted in position to said housing, wherein said fixing step includes:

an adjuster fixing step for fixing said adjuster to said housing in the case where the measured value of the spring force of said valve closing spring falls within the set control range of the spring force in said judging step.

6. The manufacturing method for a cylinder interior fuel injection valve according to claim 5, wherein the spring force is controlled so as to fall within a control range between a lower limit at which the valve opening caused by the combustion gas pressure of a combustion chamber is prevented and the valve closing condition may be maintained when said solenoid assembly is not electrically excited in an actual engine installation and an upper limit at which the valve opening condition may be maintained upon the electric excitation of said solenoid assembly in a range of the fuel pressure that may occur in an actual engine.

7. The manufacturing method for a cylinder interior fuel injection valve according to claim 5, wherein the spring force is controlled so as to fall within a control range equal to or greater than a lower limit at which the valve opening caused by the combustion gas pressure of a combustion chamber is prevented and the valve closing condition may be maintained when said solenoid assembly is not electrically excited in an actual engine installation.

8. The manufacturing method for a cylinder interior fuel injection valve according to claim 5, wherein the spring force is controlled so as to fall within a control range equal to or lower than an upper limit at which the valve opening condition may be maintained upon the electric excitation of said solenoid assembly in a range of the fuel pressure that may occur in an actual engine.

9. A manufacturing method for a cylinder interior fuel injection valve composed of, a housing having a fuel passage along an axis, a valve assembly having a valve seat provided with a fuel injection port and a valve body for contacting with or separating from said valve seat to open/close said fuel injection port and fixed to one end of said housing so as to project a side of said fuel injection port, a solenoid assembly installed in said housing for magnetically sucking said valve body in a valve opening direction, a valve closing spring received in the fuel passage of said housing for biasing said valve body in a valve closing direction, and an adjuster fixed to the fuel passage of said housing for depressing said valve closing spring toward said valve seat;

said manufacturing method comprising the steps of:

adjusting the position of said adjuster in the fuel passage of said housing so that a fuel injection amount falls within a range of a rated value of the fuel injection amount and a spring force of said valve closing spring falls within a set control range of the spring force, wherein said adjusting step includes:

an adjuster position adjusting step for measuring a spring force of said valve closing spring while changing an axial position of said adjuster within the fuel passage of said housing and for adjusting the position of said adjuster so that the measured value thereof falls within a set control range of the spring force; and a judging step for measuring the fuel injection amount in the adjuster position adjusted in said adjuster position adjusting step, judging whether or not the measured value falls within a range of a rated value of the fuel injection amount, and re-executing said adjuster position adjusting step in the case where the measured value is out of the rated value of the fuel injection amount; and fixing said adjuster which has been adjusted in position to said housing, wherein said fixing step includes:

an adjuster fixing step for fixing said adjuster to said housing in the case where the measured value of the fuel injection amount falls within the range of the rated value in said judging step.

10. The manufacturing method for a cylinder interior fuel injection valve according to claim 9, wherein the spring force is controlled so as to fall within a control range between a lower limit at which the valve opening caused by the combustion gas pressure of a combustion chamber is prevented and the valve closing condition may be maintained when said solenoid assembly is not electrically excited in an actual engine installation and an upper limit at which the valve opening condition may be maintained upon the electric excitation of said solenoid assembly in a range of the fuel pressure that may occur in an actual engine.

11. The manufacturing method for a cylinder interior fuel injection valve according to claim 9, wherein the spring force is controlled so as to fall within a control range equal to or greater than a lower limit at which the valve opening caused by the combustion gas pressure of a combustion chamber is prevented and the valve closing condition may be maintained when said solenoid assembly is not electrically excited in an actual engine installation.

12. The manufacturing method for a cylinder interior fuel injection valve according to claim 9, wherein the spring force is controlled so as to fall within a control range equal to or lower than an upper limit at which the valve opening condition may be maintained upon the electric excitation of said solenoid assembly in a range of the fuel pressure that may occur in an actual engine.

* * * * *